United States Patent [19]

Florence

[11] Patent Number: 4,679,272

[45] Date of Patent: Jul. 14, 1987

[54] TOOTHBRUSH

[75] Inventor: Max Florence, Toronto, Canada

[73] Assignee: Sulcabrush Inc., Toronto, Canada

[21] Appl. No.: 826,446

[22] Filed: Feb. 5, 1986

[51] Int. Cl.[4] ..... A46B 9/04

[52] U.S. Cl. ..... 15/106; 15/110; 15/167 R; 15/176; 128/62 A; D4/105

[58] Field of Search ..... 15/167 R, 167 A, 110, 15/176, 172, 106; 128/62 A; 433/141-143; D4/105

[56] References Cited

U.S. PATENT DOCUMENTS 2,251,853 8/1941 Pandiyan ..... 15/106 X 4,150,457 4/1979 Larson ..... 15/106

4,486,109 12/1984 Rosofsky ..... 15/110 X

FOREIGN PATENT DOCUMENTS 574577 4/1924 France ..... 15/167 R 37746 6/1906 Switzerland ..... 15/106

561300 5/1944 United Kingdom ..... 15/106

*Primary Examiner*—Peter Feldman

*Attorney, Agent, or Firm*—Rogers, Bereskin & Parr

[57] ABSTRACT

A toothbrush has an elongate handle and a brushing head. The brushing head is at an acute angle relative to the handle, to facilitate brushing of lingual surfaces. The toothbrush can include a second brushing head at the other end of the handle, which is at an obtuse angle.

11 Claims, 6 Drawing Figures

TOOTHBRUSH

FIELD OF THE INVENTION

This invention relates to a toothbrush.

BACKGROUND OF THE INVENTION

At the present time, there are a wide variety of toothbrush designs. These designs are based on a number of different theories. At one time, it was considered desirable to have hard bristles for a toothbrush. However, it was then feared that these hard bristles would result in excessive wear of the tooth enamel adjacent to the gingival margin. This was expected to occur, due to the backward and forward motion employed by many people to clean their teeth.

It was then proposed to use relatively soft bristles. The intention with soft bristles is that they will cause thorough cleaning of all tooth surfaces, etc., whilst at the same time not being so hard as to cause excessive abrasion. However, from experience it has been found that such soft-bristled toothbrushes do not always adequately clean a person's teeth.

A particular problem occurs with the teeth surfaces adjacent to the gingival margin and interproximal areas. These areas are most prone to the build up of plaque. Accordingly, the cleaning materials and techniques used should be such as to ensure adequate cleaning of these areas, without causing excessive abrasion, etc.

It is also desirable that a toothbrush should massage and invigorate the gums. However, soft-bristled toothbrushes again do not adequately massage the gums, to improve circulation, etc.

SUMMARY OF THE INVENTION

In accordance with the present invention, there is provided a toothbrush comprising an elongate handle means and a first brushing head, at one end of the elongate handle means, which brushing head has an axis and comprises a plurality of bristle elements extending outwardly from the elongate handle means around said axis, with the axis of the brushing head being at an acute angle relative to the elongate handle means.

Preferably, the toothbrush has two brushing heads. Each brushing head has a plurality of bristle elements extending outwardly from the elongate handle means. The first brushing head is at an acute angle, as mentioned whilst the other brushing head is at an obtuse angle. The brushing heads can be of otherwise similar construction, and of generally small dimensions. The bristle elements are preferably hard.

The toothbrush of the present invention thus provides two brushing heads at different angles for cleaning different tooth surfaces. In use, the brushing heads are used to clean primarily the gingival margin and interproximal areas of the teeth, and to invigorate the gums. The first brushing head is manipulated, to clean the lingual or inside surfaces of the teeth. The first brush head is vigorously manipulated, as by a rotary and/or oscillatory movement. The acute angle of the first brush head facilitates cleaning of the lingual surfaces.

The second brushing head can then be used to clean the outer or buccal surfaces. Its obtuse angle again facilitates in this respect, and it is similarly manipulated.

By vigorous brushing with the toothbrush of the present invention, having relatively stiff bristles, it has been found that one can obtain thorough cleaning of the gingival margin and interproximal areas of the teeth as well as stimulating the adjacent gum tissue. Whilst initially the gums may feel tender and may even bleed, it has been found that with regular use, these symptoms fade. Such stimulation can benefit the gums. It is expected that it can prevent any further internal bone loss where such bone loss has occurred, and limit subsequent gingival recession.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which:

Referring to FIGS. 1 and 2, the toothbrush of the present invention is generally denoted by the reference 1. The toothbrush 1 comprises an elongate handle 2, together with first and second brushing heads 4, 6.

The handle 2 is of generally rectangular cross-section. It comprises a central portion 8 which is of uniform width and depth. This central portion 8 is moulded to provide a gripping surface, denoted by the reference 10. As shown, the gripping surface can be a knurled surface, for example comprising alternate ridges and grooves encircling the handle 2. Extending from the central portion 8, there are respective first and second end portions, 12, 14. These end portions 12, 14 are extensions of the central portion 8 and taper towards their outer ends.

Figure 4:
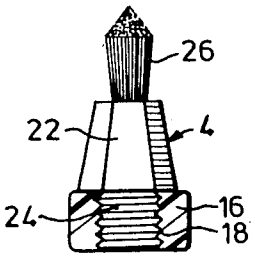
FIG. 4 shows a cross-section, similar to FIG. 3, of an alternative mounting arrangement for each head of the toothbrush.

The first end portion 12 continues into an end mounting part 16. The first end part 12 and the end mounting part 16 are at an obtuse angle relative to one another. As shown in FIG. 4, the end mounting portion 16 includes a bore 18, which is threaded.

The brushing head 4 comprises a body 22, which in this preferred embodiment is of generally hexagonal cross-section. From the lower end of the body 22, a shaft 24 extends (FIG. 4). The shaft 24 is threaded on its outside for engagement in the bore 18, as shown. Within the body 22, there is a cylindrical recess opening at the upper end of the body 22. Within this recess, a plurality of bristle elements 26 are located. The bristle elements are secured to the body 22 in known manner.

The arrangement of the second brushing head 6 corresponds in many ways to that of the first brushing head 4. The actual brushing head 6 is identical to the brushing head 4. A corresponding second end mounting part 28 continues as an extension of the second end portion 14. The second end mounting part is at an obtuse angle to the second end portion 14. Both the end mounting parts 16, 28 are inclined to be below the central portion 8 as viewed in FIG. 1. The second end mounting part 28 includes a respective threaded bore, corresponding to the threaded bore 18. The threaded shaft (not shown) of the second brushing head 6 is then screwed into this bore, as for the first brushing head 4 shown in FIG. 3.

Figure 3:
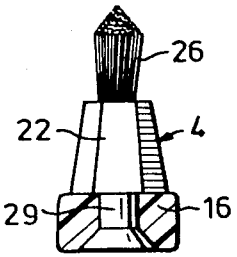
FIG. 3 shows a cross-section along line 3—3 of FIG. 2 of one head of the toothbrush.

FIG. 3 shows an alternative mounting arrangement for each head 4, 6. Here each shaft 24 is replaced by plain shaft 29 in a corresponding plain bore. The bore is countersunk at its lowermost end, and the end of the plastic shaft 29 is melted or otherwise deformed to fill the countersunk portion. This secures the head 4 or 6 by a rivet-type connection.

Figure 2:
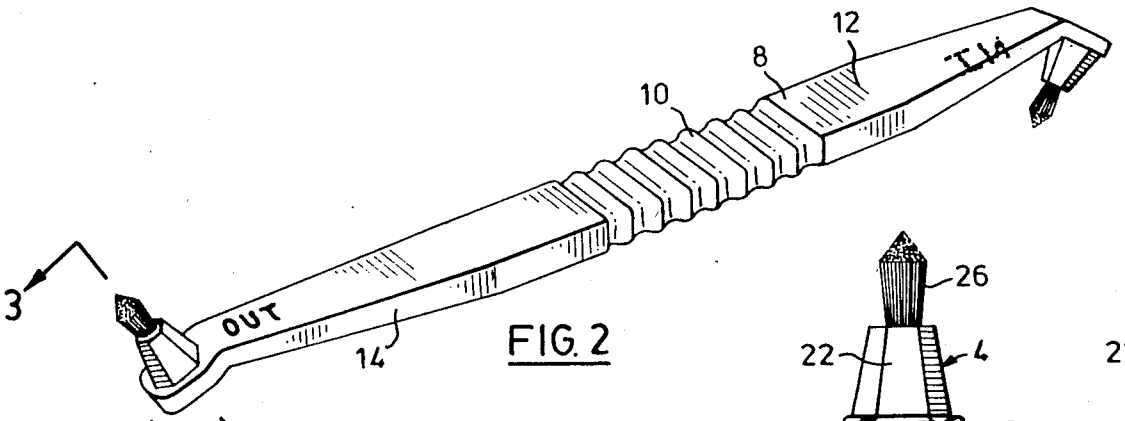
FIG. 2 shows a perspective view of the toothbrush of FIG. 1.

As shown in FIG. 2, the handle is marked with the designations "IN" and "OUT" adjacent the brushing heads 4, 6 respectively. This is to indicate that the head 4 is for use on inner surfaces, whilst the head 6 is for use on the outer surfaces. The designation "IN" is shown by dotted lines as it is on the opposite side of the handle 2 as seen in FIG. 2. These designations could be replaced by equivalent wording in any language.

Figure 1:
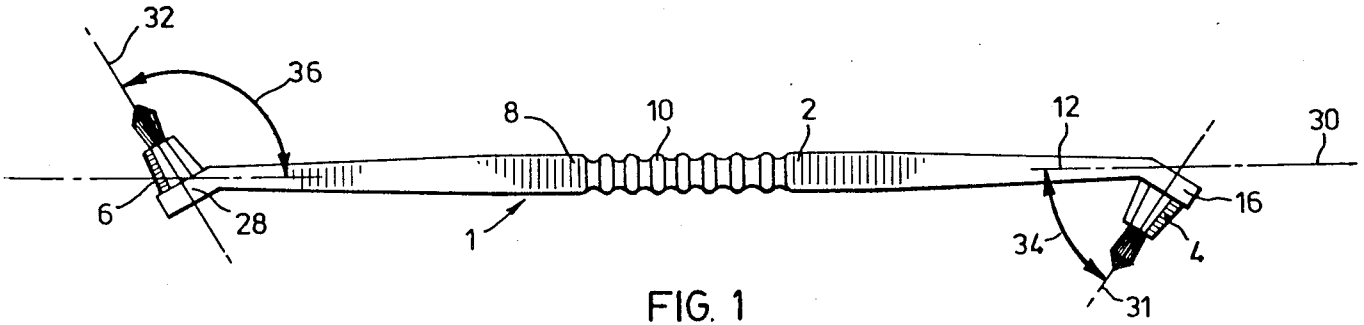
FIG. 1 shows a side view of a toothbrush according to the present invention.

In accordance with the present invention, the brushing heads 4, 6 are at different angles to the handle 2. In FIG. 1, an axis of the handle 2 is designated by the reference 30. Correspondingly, a first brush axis for the brushing head 4 is denoted by the reference 31, and a second brush axis for the second brush head 6 is denoted by the reference 32. The first brush axis 31 is at an acute angle relative to the handle axis 30, and this acute angle is shown at 34. The second brush head is at an obtuse angle to the handle 2. This obtuse angle, between the axes 30, 32 is shown at 36. Preferably, the acute angle 34 is in the range 65°–70°, preferably 65°. Correspondingly, the obtuse angle 36 is preferably in the range 120°–125°, preferably 120°.

In this embodiment the handle 2 is moulded in one piece from a plastic material. To this end, the sides of the handle 2 can be tapered slightly, in a known manner, to facilitate release from a mould. The threaded bores in the end mounting parts 16, 28 are moulded in the handle 2. For each of the brushing heads 4, 6, the body 22 together with its threaded shaft is moulded in one piece in plastic. A recess or socket for the bristle elements 26 is moulded into the body 22.

The exposed part of the body 22 has a height of approximately 7 mm. The bristle elements 26 form a tuft having an overall height of approximately 7 mm. As shown in FIG. 3, the tips of the bristle elements 26 are cut to form a cone, which has a height of approximately 2 mm. At the base of the bristle elements 26 where they leave the body 22, the tuft of bristle elements 26 has a diameter of approximately 3 mm. The bristle elements 26 are formed from 12-gauge round plastic material. There are approximately 108 bristle elements 26. The bristle elements 26 are formed in pairs, so there are approximately 54 pairs. Each pair of bristle elements 26 is joined at the bottom, and passes under a retaining member secured to the body 22.

Figure 5:
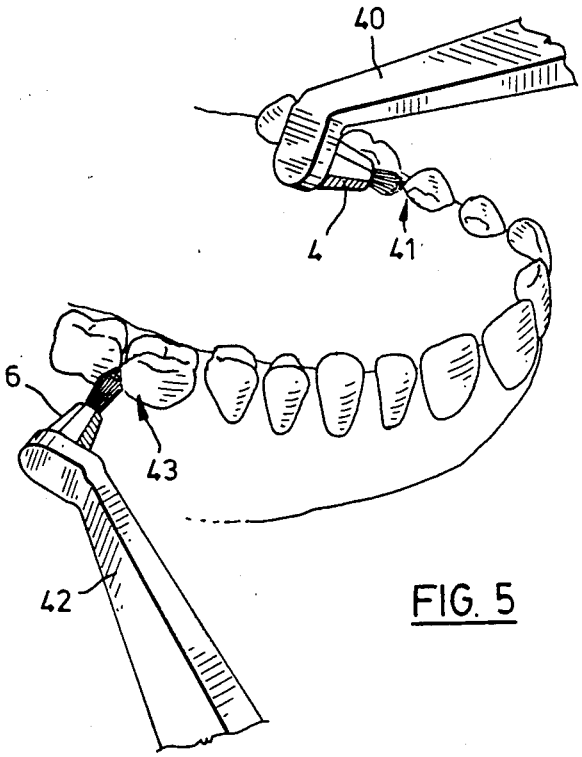
FIG. 5 shows a perspective view of the teeth of one jaw showing use of the toothbrush of FIGS. 1 and 2.
Figure 6:
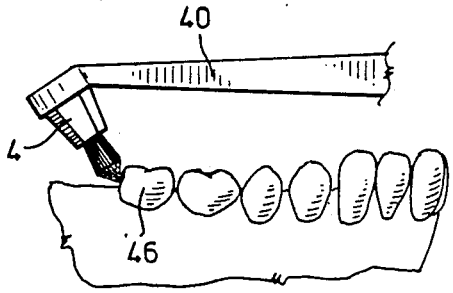
FIG. 6 shows a side view of the molars of one jaw, showing use of the toothbrush of the present invention.

Reference will now be made to FIGS. 5 and 6, which show use of the toothbrush shown in FIGS. 1, 2. In FIG. 5, the toothbrush 1 is shown twice. The toothbrush is shown at 40 with the brushing head 4 in use. Correspondingly, the toothbrush is shown at 42 with the head 6 in operation.

FIG. 5 shows the lingual surfaces 41 of the lower jaw. The first brushing head 4 of the toothbrush 40 is brought up against the lingual surface of the teeth. The brushing head 4 is vigorously applied to the gingival margin and interproximal areas of the teeth. The brushing head 4 can be applied in a variety of ways, such as a vibratory, rotary or oscillatory action. This should clean the surface of the teeth adjacent to the gums, whilst simultaneously massaging the gingival margin. For each jaw, the brushing head 4 can be applied to one end of the row of teeth and then moved slowly around to the other end. As shown in FIG. 6, the brushing head 4 is also used to clean behind the rear-most molars. The acute angle 34 permits the brushing head 4 to reach into the mouth, and to contact the lingual surfaces, and also the rear surfaces of the molars shown in FIG. 6 at a good angle. From experience, it has been found that the obtuse angle 36 of the brushing head 6 makes it unsuitable for use on the lingual surfaces. As shown in FIG. 5, the toothbrush 40 is held extending across the row of teeth. The acute angle 34 then angles the brushing head 4 downwards and backwards, so that it is at the correct angle for brushing the gingival margin, etc.

To clean the buccal surfaces 43 of the teeth, the brushing head is used, as shown for the toothbrush 42. Again, the use will ideally start at one end of the row of teeth and work around slowly to the other end. The brushing head 6 is applied to the gingival margin. Again, it is vigorously moved as by a vibrating or oscillatory action This will clean the buccal surfaces 43 and invigorate and massage the gums.

It is preferred that the toothbrush of the present invention is used 2–3 times a day after meals. Each brushing session should take around two minutes. It has been found that initially, the gums may be slightly tender and possibly there may be some gingival bleeding. However, experience shows that the gum tissue quickly adapts to the extra stimulation. This extra stimulation improves the gum tissue. Ideally, the bristle elements 26 should be applied with sufficient pressure to cause the gums to blanch, to be effective.

Experience suggests that by regular and careful use of the toothbrush, the buildup of plaque, etc., on tooth surfaces inaccessible to conventional toothbrushes can be largely eliminated. Further, it is believed that use of this toothbrush will prevent further internal bone loss where this has occurred, or further gingival recession. Provided the toothbrush is used properly and routinely, then it should be possible to maintain good dental health.

It is to be appreciated that, whilst a preferred embodiment of the invention has been described, many variations are possible. Thus, although the bristle elements are shown mounted in separate bodies screwed into the handle, the bristle elements could be secured directly into the handle. Also, the size, shape and general arrangement of the brushing elements 4, 6 can be varied. Also, a mixture of different types, sizes, etc. of fibres could be employed.

I claim:

1. A toothbrush comprising an elongate, generally straight handle means, having first and second ends, and first and second brushing heads which have respective first and second axes and are generally identical, and each of which comprises a plurality of bristle elements forming a single rounded tuft which tuft has a height greater than its diameter and extends outwards about the respective first or second axis, with the first brushing head extending at an acute angle to the handle means on one side thereof and the second brushing head extending at an obtuse angle to the handle means on the other side thereof.

2. A toothbrush as claimed in claim 1, wherein the acute angle of the first brushing head is in the range 65°–70°.

3. The toothbrush as claimed in claim 1, wherein the acute angle of the first brushing head is in the range 65°–70° and the obtuse angle of the second brushing head is in the range 120°–125°.

4. A toothbrush comprising an elongate, generally straight handle means having first and second ends, and first and second brushing heads which have respective first and second axes and are generally identical, and each of which comprises a body and bristle elements secured in the body to form a single rounded tuft which tuft has a height greater than its diameter and extends outwards about the respective first or second axis, with the body of the first brushing head secured to the first end and extending on one side of the handle with the first axis at an acute angle to the handle and with the body of the second brushing head secured to the second end and extending on the other side of the handle with the second axis at an obtuse angle to the handle.

5. A toothbrush as claimed in claim 4, wherein the bristle elements comprise 12 gauge plastic material and the bristle elements of each brushing head comprise a single round tuft.

6. A toothbrush as claimed in claim 4 or 5, wherein the body of each brushing head includes a plain shaft, and wherein, at each end of the elongate handle means, there, is a plain bore enlarged at one end, the free end of each shaft being expanded into a respective enlarged end of a bore, to secure the respective head.

7. A toothbrush as claimed in claim 4 or 5, wherein the body of each brushing head includes a screw shaft, and wherein the elongate handle means includes threaded bores at either end, to receive the screw shafts.

8. A toothbrush as claimed in claim 1, wherein each brushing head comprises a plurality of bristle elements mounted in the elongate handle means.

9. A toothbrush as claimed in claim 1, 3 or 4, wherein a central portion of the elongate handle means includes a knurled gripping surface.

10. A toothbrush as claimed in claim 1, 3, or 4, which includes the markings "IN" and "OUT" adjacent the first and second brushing heads respectively.

11. A toothbrush comprising: an elongate handle means moulded from a plastic material and comprising a central portion, provided with a knurled gripping surface, first and second end portions which are continuous with the central portion with each of the first end, second end and central portions being of generally equal length, a handle axis extending through the first end, second end and central portions, and first and second end mounting parts each of which extends at an obtuse angle from the respective first or second end portion, with the first and second end mounting parts extending on the same side of the handle means; a first brushing head secured to the first end mounting part adjacent the first end portion which brushing head has a first axis and comprises a plurality of plastic bristle elements forming a single tuft extending outwardly from the elongate handle means around the first axis with the first axis being at an acute angle to the handle axis; a second brushing head secured to the second end mounting part adjacent the second end portion, which second brushing head has a second axis and comprises a plurality of plastic bristle elements forming a single tuft extending outwardly from the elongate handle means around the second axis, with the second axis being at an obtuse angle to the handle axis, and markings "IN" and "OUT" on the first and second end portions adjacent to the first and second brushing heads respectively.

* * * * *